US006964173B2

(12) United States Patent
Dobmeier et al.

(10) Patent No.: US 6,964,173 B2
(45) Date of Patent: Nov. 15, 2005

(54) EXPANSION DEVICE WITH LOW REFRIGERANT CHARGE MONITORING

(75) Inventors: Thomas J. Dobmeier, Phoenix, NY (US); Michael F. Taras, Fayetteville, NY (US); Alexander Lifson, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 39 days.

(21) Appl. No.: 10/695,123

(22) Filed: Oct. 28, 2003

(65) Prior Publication Data

US 2005/0086951 A1 Apr. 28, 2005

(51) Int. Cl.[7] ..... F25B 49/02
(52) U.S. Cl. ..... 62/129; 62/131
(58) Field of Search ..... 62/125, 126, 127, 62/129, 131

(56) References Cited

U.S. PATENT DOCUMENTS 4,876,859 A 10/1989 Kitamoto
5,241,833 A * 9/1993 Ohkoshi ..... 62/126
5,243,829 A * 9/1993 Bessler ..... 62/126
5,623,834 A * 4/1997 Bahel et al. ..... 62/131
5,875,637 A 3/1999 Paetow
6,047,556 A 4/2000 Lifson
6,206,652 B1 3/2001 Caillat
6,460,354 B2 * 10/2002 Yabuki et al. ..... 62/129

OTHER PUBLICATIONS

Systems & Advanced Technologies Engineering S.r.l., publication entitled "Compsys-Dynamic Simulation of Gas Compression Plants".
Copeland Application Guideline for Refrigeration Scroll for Parallel Applications.
International Search Report, Apr. 6, 2005.

* cited by examiner

*Primary Examiner*—Harry B. Tanner
(74) *Attorney, Agent, or Firm*—Carlson, Gaskey & Olds

(57) ABSTRACT

An air conditioning or refrigeration system includes an expansion device that has a plurality of operating positions. When the expansion device is in a fully open position, the expansion device provides an indication to a system controller regarding that position. The controller responsively determines if the fully open position of the expansion device is caused by an undesirably low amount of refrigerant charge in the system. In one example, the controller rules out other possible reasons for the expansion device being in the fully open position. In one example, the controller automatically shuts down appropriate portions of the system to avoid any component damage that may result from having too low refrigerant amount in the system.

14 Claims, 1 Drawing Sheet

EXPANSION DEVICE WITH LOW REFRIGERANT CHARGE MONITORING

FIELD OF THE INVENTION

This invention generally relates to air conditioning and refrigeration systems. More particularly, this invention relates to monitoring an amount of refrigerant charge within an air conditioning or refrigeration system and determining if amount of refrigerant is insufficient for proper system operation.

DESCRIPTION OF THE RELATED ART

Air conditioning and refrigeration systems typically utilize a certain refrigerant charge within the system, to achieve a desired amount of cooling within a building, for example. Having an adequate amount of refrigerant within the system is also necessary to prevent damage to the system components, such as the compressor.

It is possible for the refrigerant charge in the system to be lost or reduced to a level that hinders the ability of the system to provide adequate cooling. Moreover, a loss of refrigerant charge may cause damage to the system components such as the compressor. Typical causes of inadequate refrigerant amounts include inadequate charge at the factory or during installation in the field or leakage through damaged components or loose connections.

It is necessary to detect a loss of refrigerant charge as early as possible to avoid interrupting system operation, especially during high ambient temperature conditions, when adequate cooling at full-load operation is essential to end users. It is also prudent and critical to diagnose a loss-of-charge failure mode as early as possible to avoid system component damage, because, for instance, loss-of-charge is one of the foremost causes of compressor failures in the field. While proposals have been made for detecting a loss of refrigerant charge, known arrangements do not provide an early enough indication or are not reliable enough because they can be mistaken for some other system malfunctions such as an evaporator airflow blockage, compressor damage or a plugged distributor. Using known techniques and trying to differentiate between such failure modes requires exhaustive troubleshooting. Furthermore, other consequences of the charge loss, such as detection of low suction pressure (i.e., by tripping on a low-pressure switch), usually occur late in the process and applying them may not prevent compressor damage.

In addition, the need for monitoring refrigerant charge becomes especially acute with the introduction of systems that utilize high pressure refrigerants such as R410A and $CO_2$. Systems with these refrigerants are more prone to leaks.

This invention provides a unique way of monitoring the amount of refrigerant charge within an air conditioning system that decreases the likelihood of an interruption in the desired system performance that would otherwise be caused by a refrigerant charge loss. The invention also provides the ability to determine loss-of-charge conditions very early in its occurrence such that preemptive measures can be executed to prevent compressor damage and to avoid prolonged shutdowns and expensive repairs.

SUMMARY OF THE INVENTION

This invention utilizes information regarding an expansion device opening for monitoring an amount of refrigerant charge in an air conditioning or refrigeration system.

One example method includes determining an operating position of the expansion device that has a fully open position as one of a plurality of possible operating positions. In this example, the method includes determining when the expansion device is in the fully open position. That position is used as an indication that the refrigerant charge may be below a desired level.

In one example, a system controller determines whether other system operating characteristics indicate that the expansion device should be in the fully open position for a reason other than the refrigerant charge amount being below the desired level.

An example air conditioning system designed according to this invention includes a compressor, a condenser and an evaporator. An expansion device is positioned between the condenser and the evaporator. The expansion device has a fully open position, where the expansion device allows a maximum refrigerant flow to circulate through the system. A controller determines if an amount of refrigerant in the system is below a desired amount responsive to the expansion device being in the fully open position and if system operating conditions should correspond to such a fully open position of the expansion device.

In one example, the expansion device includes a switch that is activated to provide a signal to the controller when the expansion device is in the fully open position.

The various features and advantages of this invention will become apparent to those skilled in the art from the following description of the currently preferred embodiments. The drawings that accompany the detailed description can be described as follows.

DETAILED DESCRIPTION OF THE PREFERRED EMBODIMENT

Figure 1:
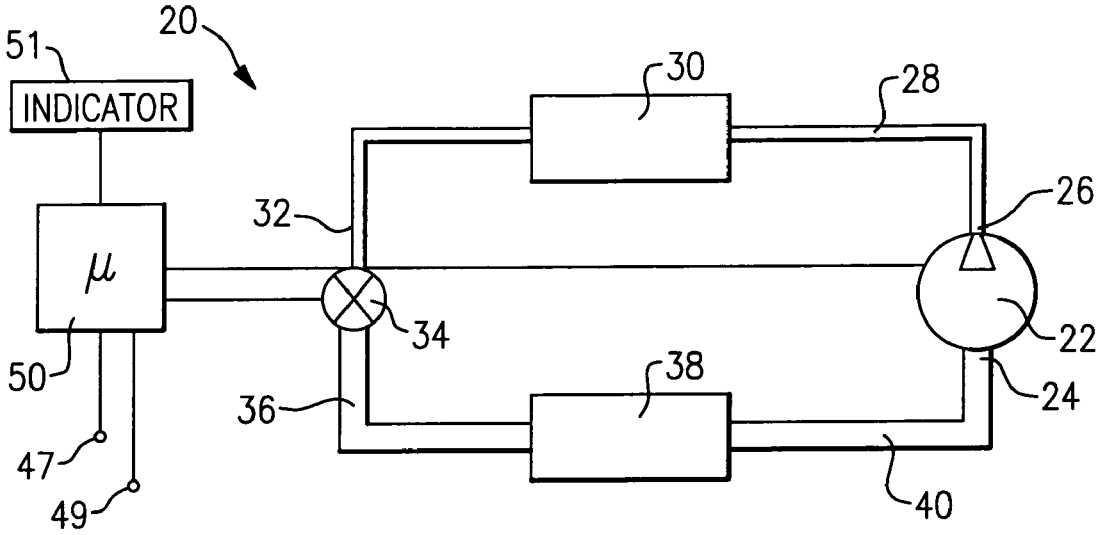
FIG. 1 schematically illustrates a refrigerant system incorporating an expansion device whose operating position is useful for monitoring an amount of refrigerant charge in the system.

FIG. 1 schematically shows a refrigerant system 20 that may be used as an air conditioning or a refrigeration system. In a cooling mode, a compressor 22 draws refrigerant into a suction port 24 at low pressure and provides a compressed gas into a conduit 28 out of a discharge port 26. The high temperature, pressurized gas flows through the conduit 28 to a condenser 30 where the gas dissipates heat and usually condenses into a liquid as known. The liquid refrigerant flows through a conduit 32 to an expansion device 34.

In one example, the expansion device 34 is a valve that operates in a known manner to allow the liquid refrigerant to partially evaporate and flow into a conduit 36 in the form of a cold, low pressure refrigerant. This refrigerant then flows through an evaporator 38 where the refrigerant absorbs heat from air that flows across the evaporator coil. Subsequently, cool air cools the desired space as known. The refrigerant exiting the evaporator 38 flows through a conduit 40 to the suction port 24 of the compressor 22 where the cycle continues. In one example, the system 20 may also be used as a heat pump where the just-described flow may be reversed as known. Some example systems operate in both modes as known and can be utilized as well.

Figure 2:
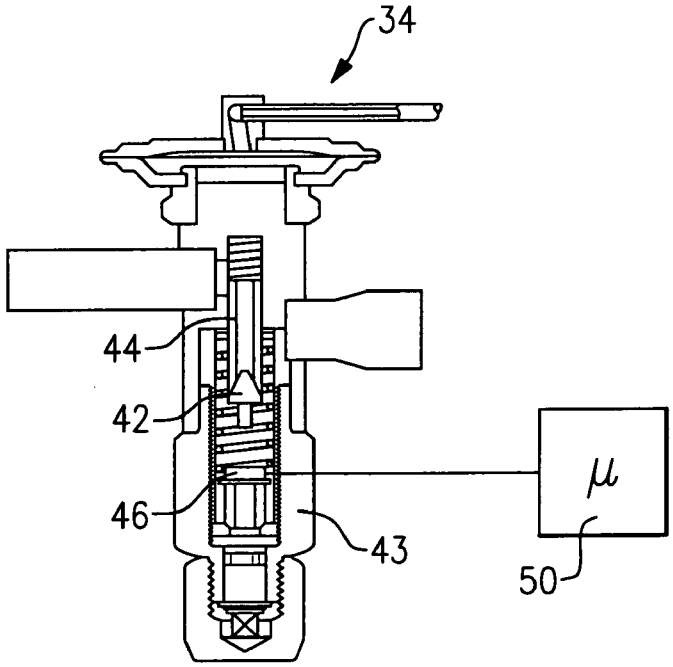
FIG. 2 is a cross-sectional illustration of an example expansion device useful with an embodiment of this invention.

FIG. 2 illustrates an example expansion device 34 that has a plunger member 42 that is moveable within a housing 43 to selectively control an amount of refrigerant flow through a flow channel 44. The plunger member 42 is moveable between a plurality of operating positions within the housing 43. In the example of FIG. 2, the plunger member 42 is shown in an equalizing position where it closes off the flow channel 44. This position can be referred to as a fully closed position.

At an opposite extreme, the plunger member 42 moves to a fully open position where the lower (according to the drawing) end of the plunger member 42 contacts a switch 46 that is supported within the housing 43. The fully open position allows a maximum amount of refrigerant flow through the expansion device 34. Once the plunger member 42 contacts the switch 46 in this example, the switch 46 is activated to send a signal to a controller 50 indicating that the plunger member 42 is in the fully open position. The controller 50 responsively determines if the amount of refrigerant charge within the system is below a desired value.

In one example, the controller 50 automatically determines that the refrigerant amount is too low as soon as a signal is received from the switch 46. In another example, the controller 50 is programmed to determine whether other system characteristics and operating regimes using known techniques may be responsible for the plunger member 42 moving into the fully open position. In this example, the controller determines whether another operating regime, such as the so-called pull-down mode, is the reason for the plunger member 42 being in the fully open position. The controller 50 in this example uses determinations regarding indoor and outdoor temperatures (see sensors 47 and 49) or a system operating pressure as a check on the reason for the expansion device 34 being in the fully open position. Also the difference between the low side and high side refrigerant pressures can be taken. Those skilled in the art who have the benefit of this description will be able to choose appropriate criteria to perform a check suitable for their particular situation. Similarly, those skilled in the art who have the benefit of this description will be able to suitably program a microprocessor or other controller to make the appropriate discrimination between a fully open expansion device caused by a decreased refrigerant charge, depending on the particular characteristics of their particular air conditioning or refrigeration system arrangement.

As the system 20 loses refrigerant charge, the expansion device 34 will continue to open wider to compensate for the insufficient subcooling and refrigerant flow to maintain the required superheat after the evaporator 38 coils. The expansion device 34 provides an indication to the controller 50 that the device is in a fully open position, which gives the controller 50 the ability to monitor the refrigerant charge amount within the system 20. The controller 50 determines that the charge amount is below a desired level (unless other system operating characteristics provide an indication that there is a different reason for the expansion device 34 being in the fully open position).

In one example, the switch 46 is a discrete switch that provides a signal anytime there is contact between the plunger member 42 and an appropriate portion of the switch 46. The switch 46 is positioned within the expansion device 34 so that such contact occurs when the plunger member 42 moves into the fully open position. The switch 46 may take a variety of forms including a resistance-based switch, a conductance-based switch, a capacitance-type switch, a proximity switch, an optical sensor or another known type of switch. Those skilled in the art who have the benefit of this description will realize what components to select to best meet the needs of their particular situation.

In one example, the controller 50 is programmed to automatically shut down at least the compressor 22 of the system responsive to determining that the refrigerant charge amount is below a desired level. In this example, the controller 50 is useful for preventing possible damage to operating components of the system that might otherwise occur as a result of a reduced refrigerant charge. This example embodiment provides an enhanced capability of determining when refrigerant charge amount is becoming low enough to present potential problems to the system components to provide early warning regarding such a situation well in advance of what was possible with prior approaches.

In one example, the controller 50 provides an indication (51), such as a visible message or an audible alarm, that the refrigerant charge is too low.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of monitoring an amount of refrigerant in a refrigerant system that has an expansion device, comprising:

determining an operating position of the expansion device;

the expansion device having a plurality of operating positions including a fully open position and the method includes determining when the expansion device is in the fully open position:

determining when at least one other system characteristic indicates that the expansion device is in the fully open position for a reason other than the amount of refrigerant being below the desired amount; and monitoring at least one of an indoor temperature, an outdoor temperature, a system low side pressure, or a system high side pressure to determine if the expansion device is in the fully open position for a reason other than the amount of refrigerant being below the desired amount.

2. The method of claim 1, including associating a switch with the expansion device such that the switch provides an indication of when the expansion device is in the fully open position.

3. The method as set forth in claim 1, wherein said refrigerant system includes a compressor, and said compressor being at least partially shut down in response to a determination that the amount of refrigerant is below a desired amount.

4. The method of claim 1, further including the step of determining the amount of refrigerant is below a desired amount responsive to determining that the expansion device is in the fully open position and determining that the expansion device is not the fully open position for a reason other than the amount of refrigerant being below the desired amount.

5. A refrigerant system, comprising:

a compressor;

a condenser in fluid communication with at least the compressor;

an evaporator in fluid communication with at least the condenser;

an expansion device between the condenser and the evaporator, the expansion device having a fully open position where the expansion device allows a maximum flow between the condenser and the evaporator;

a controller that determines if an amount of refrigerant in the system is below a desired amount responsive to the expansion device being in the fully open position;

the controller monitors when at least one other system characteristic indicates that the expansion device is in the fully open position for a reason other than the amount of refrigerant being below the desired amount; and the controller determines at least one of an indoor temperature, an outdoor temperature, a system low side pressure or a system high side pressure to determine if the expansion device is in the fully open position for a reason other than the amount of refrigerant being below the desired amount.

6. The system of claim 5, wherein the expansion device provides an indication of when the expansion device is in the fully open position to the controller.

7. The system of claim 6, including a switch associated with the expansion device, the switch being activated to provide a signal to the controller when the expansion device is in the fully open position.

8. The system of claim 7, wherein the switch is positioned within the expansion device and the expansion device includes a plunger member that activates the switch when the plunger member moves into the fully open position.

9. The system of claim 5, wherein the controller automatically shuts down at least a portion of the system responsive to determining that the amount of refrigerant is below a desired amount.

10. The system of claim 5, wherein the controller provides an indication that the refrigerant amount is below the desired amount, when said controller has determined that said at least one other system characteristic does not indicate that the expansion device is in the fully open position for a reason other than the amount of refrigerant being below the desired amount.

11. A method of monitoring an amount of refrigerant in a refrigerant system that has an expansion device, comprising:

determining an operating position of the expansion device;

the expansion device having a plurality of operating positions including a fully open position and the method includes determining when the expansion device is in the fully open position;

determining when at least one other system characteristic indicates that the expansion device is in the fully open position for a reason other than the amount of refrigerant being below the desired amount;

determining the amount of refrigerant is below a desired amount responsive to determining that the expansion device is in the fully open position and determining that the expansion device is not the fully open position for a reason other than the amount of refrigerant being below the desired amount; and the refrigerant system incorporating a compressor, and the method further including the step of at least partially shutting down said compressor when a determination is made that the amount of refrigerant in the system is below the desired amount.

12. The method as set forth in claim 11, wherein said compressor is entirely shut down.

13. A refrigerant system, comprising:

a compressor;

a condenser in fluid communication with at least the compressor;

an evaporator in fluid communication with at least the condenser;

an expansion device between the condenser and the evaporator, the expansion device having a fully open position where the expansion device allows a maximum flow between the condenser and the evaporator;

a controller that determines if an amount of refrigerant in the system is below a desired amount responsive to the expansion device being in the fully open position;

the controller determines when at least one other system characteristic indicates that the expansion device is in the fully open position for a reason other than the amount of refrigerant being below the desired amount; and the controller at least partially shutting down said compressor when a determination is made that the amount of refrigerant in the system is below the desired amount and the at least one other system characteristic does not indicate a reason other than the amount of refrigerant being below the desired amount.

14. The system as set forth in claim 13, wherein said compressor is entirely shut down.

* * * * *